United States Patent [19]

Mendola

[11] 4,360,235

[45] Nov. 23, 1982

[54] CUTTING AND CHISELING ASSEMBLY FOR MINING MACHINE AND METHOD PERFORMED THEREBY

[75] Inventor: Charles F. Mendola, South Bend, Ind.

[73] Assignee: John J. Simala, South Bend, Ind. ; a part interest

[21] Appl. No.: 251,383

[22] Filed: Apr. 6, 1981

Related U.S. Application Data

[62] Division of Ser. No. 106,679, Dec. 26, 1979, Pat. No. 4,298,232.

[51] Int. Cl.[3] ..... E21C 27/12

[52] U.S. Cl. ..... 299/18; 299/64

[58] Field of Search ..... 299/18, 64, 65, 66, 299/81

[56] References Cited

U.S. PATENT DOCUMENTS 1,127,395 2/1915 Bemies ..... 299/65
2,194,474 3/1940 Joy ..... 299/81 X
3,006,624 10/1961 Doxey ..... 299/65

FOREIGN PATENT DOCUMENTS 518972 10/1953 Belgium ..... 299/65

*Primary Examiner*—Ernest R. Purser
*Attorney, Agent, or Firm*—Marmaduke A. Hobbs

[57] ABSTRACT

An ore dislodging mechanism and a method for extracting ore from a vein which greatly increase productivity and reduce health hazards when compared with previous devices and methods. The ore dislodging mechanism includes a chisel bar which is forced into the ore vein to dislodge ore therefrom, and an elevated means for raising the chisel bar in a substantially vertical manner so that each extraction made by the chisel bar is parallel with previous extractions. Side cutters extend vertical kerfs along the sides of the chisel bar and the chisel bar breaks down the coal between the kerfs.

The method includes the steps of undercutting a vein of ore, extending at least one vertical relief cut upwardly from the undercut, forcing a chisel bar into the vein of ore, thereby dislodging the ore therefrom, and raising the means for cutting the relief cuts and the chisel bar mechanism to make progressively higher extractions parallel with lower extractions.

18 Claims, 14 Drawing Figures

CUTTING AND CHISELING ASSEMBLY FOR MINING MACHINE AND METHOD PERFORMED THEREBY

This application is a division of application Ser. No. 106,679 filed Dec. 26, 1979 and now U.S. Pat. No. 4,298,232.

The realization that supplies of natural gas and oil are severely limited has created a renewed interest in the use of coal as a fuel source. The relatively abundant supplies of coal make coal a more suitable fuel source for long range energy planning than oil or natural gas. Unfortunately, many health and safety problems have existed in the mining industry; hence, federal and state safety laws have been enacted to reduce the dangers associated with coal mining. The result has been that compliance with governmental standards has decreased efficiency and increased the cost of coal mining, thereby reducing production output. The decreased output in the face of potentially significant increased demands has amplified the need for new, safer, yet more efficient mining procedures.

Prior to this time, two basic mining procedures have been used, conventional mining and continuous mining. In conventional mining the vein of coal to be mined is first undercut; then holes are drilled in the vein and explosives are inserted. The explosives are detonated to loosen chunks from the coal vein, and the chunks are loaded into trolleys or other mine cars to be carried from the mine. In continuous mining the continuous mining machine advances through the coal vein and grinds or pulverizes the coal as it advances. The pulverized coal is carried by conveyors to the rear of the continuous mining machine and is loaded into cars for removal from the mine. Continuous mining provides a mined material which is well ground or pulverized, whereas conventional mining provides a larger size of material. Each method has different advantages and disadvantages, and neither is fully compatible with the prospective increased demand for coal coupled with the increased emphasis on safety standards. Continuous mining is thought to be faster and more efficient, providing greater coal output than conventional mining. Less labor is involved in continuous mining, and drilling and blasting are eliminated; hence, continuous mining is more cost efficient than conventional mining. One of the principal difficulties associated with continuous mining is that the grinding or pulverizing process by which the coal is removed from the coal vein creates substantial amounts of coal dust. Many respiratory diseases have been associated with coal dust; therefore, both federal and state standards have placed an increased emphasis on the reduction of coal dust in the mine. The grinding process utilized in continuous mining also releases increased amounts of methane gas in the mine. To minimize the dust and methane gas concentrations resulting from continuous mining operations, high quantity ventilation systems and water spray at the working face have been used. These protective systems require the expenditure of large amounts of energy to operate fans and pumps and are therefore energy wasteful. Sensing devices have been used which shut down the continuous mining machine when methane gas concentrations are higher than safety levels permit, thereby bringing the extraction process to a halt until the methane level is reduced. The continuous mining machines also produce high noise levels within the mine tunnel which can cause hearing loss as well as poor communication between mine workers, possibly resulting in injurious or fatal mine accidents. It is clear that presently available continuous mining machines operate in a manner which is in direct conflict with existing health and safety requirements. To meet these requirements, modifications of the continuous mining procedure have resulted in lower production output and higher energy costs for production.

Conventional mining procedures result in a larger lump size of mined material; thus, less dust and methane gas are released, and less ventilation and water spray are required. Cleaning sulfur from the coal, handling and transporting of the mined material obtained from conventional mining are easier because the material is larger. Better health and safety conditions exist than in continuous mining and lower capital expenditure is needed to install this type of mining operation; however, coal output per man hour is less than in continuous mining operations because more labor is required in the conventional method. Thus, a conflict exists between the two commonly used mining procedures in that the most cost efficient method, the continuous mining method, is more difficult to bring within safety and health standards, and the safer method, the conventional mining method, does not produce coal efficiently enough to meet the increasing demand for coal while maintaining reasonable coal prices.

Both previously described mining methods normally employ the use of electric motors of high voltage very close to the working face of the coal vein where dust and methane gas concentration levels are highest and the danger of explosion is greatest. High pressure water lines and/or electric cables require that workers move them as the machine is moved. Also, the use of explosives in the conventional mining method is dangerous, in that again methane gas and dust concentration levels are greatest in the area where the explosives are used, and therefore, the likelihood of combustion is great.

It is therefore one of the principal objects of the present invention to provide a mining machine which combines the advantages of continuous mining with the advantages of conventional mining and substantially eliminates the disadvantages of each, and which will produce a raw product efficiently, cheaply and cleanly, while remaining in compliance with presently existing federal and state safety laws.

Another object of the present invention is to provide a mining machine which undercuts the bottom of the coal vein and cuts vertically on both sides to separate the material horizontally and vertically, and which substantially reduces the dust and noise resulting from the mining operation compared with existing continuous mining.

Yet another object of the present invention is to provide a mining machine and a method of ore extraction which produce mined coal of a size requiring less processing to clean the sulfur therefrom, and which produce less methane gas in the mining operation, due to the lump size of the mined material.

A further object of the present invention is to provide a mining machine which results in increased mining efficiency by extracting more coal or other mined deposit per time period than do presently used methods, and which allows the desired mined material to be separated from the undesired material found in the ore vein during the extraction from the vein.

A still further object of the present invention is to provide a mining machine which employs hydraulic motors and other nonelectric components near the working face to substantially reduce the possibility of combustion or explosion of dust and methane gas, and which has a self contained water supply and spraying system to control the minimal amounts of dust which do occur.

Still another object of the present invention is to provide a mining machine which is economically beneficial to install and use, and which requires less energy in operation, resulting in lower production costs which can be passed on to the ultimate consumer.

Yet a further object of the present invention is to provide a method for extracting undergound deposits which permits the separation of seams of undesired material from the desired deposit, and to provide a dislodging mechanism which makes a series of vertically higher extractions, each relatively parallel with lower extractions.

Additional objects and advantages of the present invention will become apparent from the following detailed description and the accompanying drawings.

Figure 1:
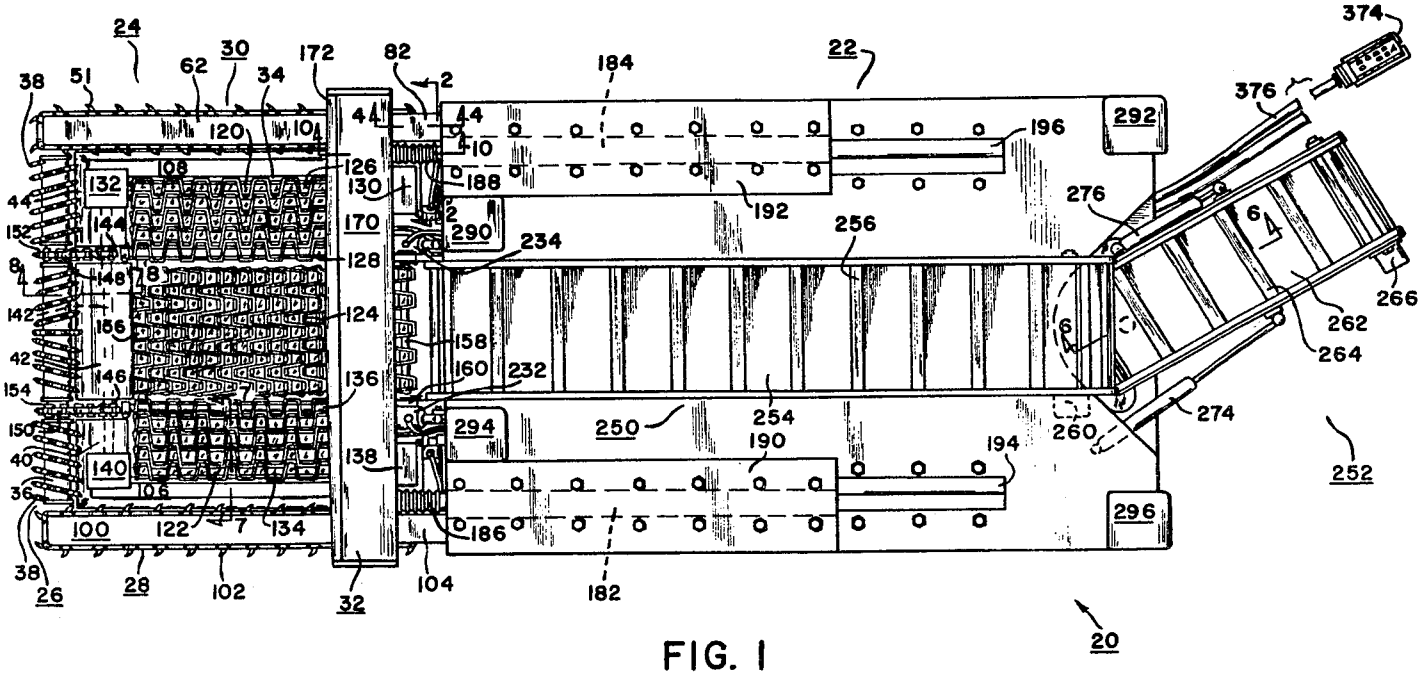
FIG. 1 is a top plan view of a mining machine embodying the present invention.

Referring more specifically to the drawings, and to FIG. 1 in particular, numeral 20 designates a mining machine of the present invention having a main body propulsion and conveyor unit 22 with an ore dislodging and collecting mechanism 24 attached on the front thereof. The dislodging and collecting mechanism extracts the coal or other ore from the vein 25 in a substantially continuous operation, collects the dislodged coal, and transfers it to the main body unit 22 to be transported on conveyors and loaded into mine cars for removal from the mine. Although described in reference to coal mining, it should be understood that, with slight modifications, the mining machine of the present invention may be used in underground mining of other ores and minerals.

Ore dislodging and collecting mechanism 24 has a front undercutting drum assembly 26 which extends across the front of mining machine 20 and channels into the coal vein at the floor level of the mine tunnel during the initial mining machine entry. Side relief cutting assemblies 28 and 30 make vertical relief cuts or kerfs on the left and right sides, respectively, of the undercut made by undercutting drum assembly 26. The relief cuts extend upwardly from the undercut a predetermined height to reach the level of a chisel bar assembly 2. When the undercut and relief cuts are completed, the chisel bar assembly is hydraulically forced into the coal vein to break loose the coal above the undercut and between the relief cuts. The coal falls into a collecting conveyor system 34 located between relief cutting assemblies 28 and 30 which moves the coal dislodged by the cutting assemblies and the chisel bar rearwardly to main body unit 22 to be loaded into shuttle cars for removal from the mine.

Figure 2:
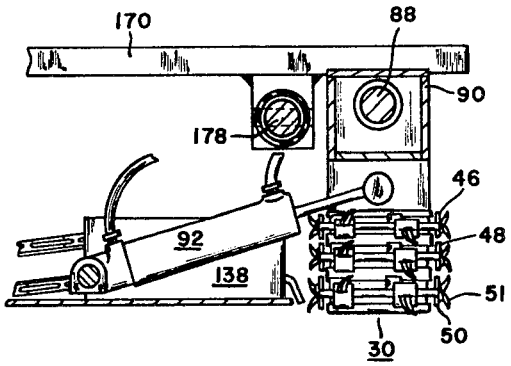
FIG. 2 is a vertical cross sectional view of the right swing bar assembly of the mining machine shown in FIG. 1, taken on line 2—2 of the latter figure.
Figure 3:
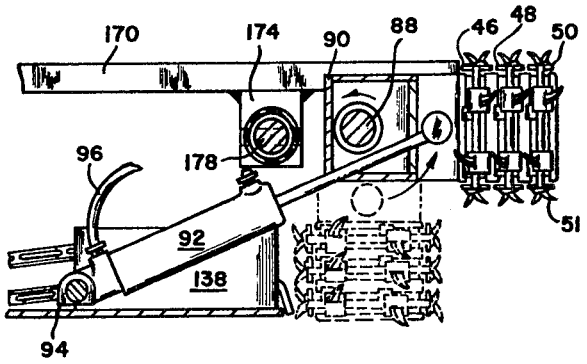
FIG. 3 is a cross sectional view similar to that shown in FIG. 2, but having the swing bar assembly in a different position from that shown in FIG. 2.

Undercutting drum assembly 26 includes a rotating drum 36 having a plurality of spaced cutting teeth 38 thereon which cut away the coal from the coal vein 25 as mining machine 20 advances. The coal cut away by teeth 38 is directed by spring plates 40, 42 and 44 into conveyor collecting system 34. Side relief cutting assemblies 28 and 30 are held in the lowered position, as shown in FIG. 2, when the advance undercut is made, and laterally extend the undercut beyond that made by drum assembly 26. Relief cutting assembly 30 on the right side of the mining machine has three cutting chains 46, 48 and 50 having a series of teeth 51 thereon, as can be most clearly seen in FIGS. 2, 3 and 4. Chains 46, 48 and 50 are engaged on sprockets 52, 54 and 56, respectively, mounted on a drive shaft 58 driven by a hudraulic motor 60. The chains are engaged on idler sprockets, not shown, on the front near undercutting assembly 26. A top assembly cover 62 and bottom assembly cover 64 enclose the sprockets and chains, with only the cutting teeth 51 extending outwardly beyond the side edges thereof. The hydraulic motor 60 is secured by a motor bracket 80 within a motor housing 82. Supply and return hydraulic lines 84 and 86, respectively, connect hydraulic motor 60 with the main hydraulic reservoir of the mining machine. The entire relief cutting assembly is rotatably mounted about a pivot shaft 88 enclosed in a shaft housing 90, and a hydraulic cylinder 92 is connected between the relief cutting assembly and a fixture 94 on a body plate of the machine. Hydraulic supply and return lines 96 and 98, respectively, connect cylinder 92 to the main hydraulic system of the mining machine. Hence, hydraulic cylinder 92 can move the cutting assembly from a lowered position, as shown in FIG. 2, to a raised position, as shown in FIG. 3, which is even with the chisel bar assembly 32. Movement from the lowered to the raised position is done while chains 46, 48 and 50 are being driven by motor 60. Hence, teeth 51 cut into the coal vein as the relief cutting assembly is raised, and a kerf is made upwardly from the undercut. The left side relief cutting assembly 28 is similar to that just described for the right side relief cutting assembly 30. The top plate 100 is shown in FIG. 1, as are the chain cutting teeth 102 and hydraulic motor housing 104. Spring plates 106 and 108 direct the coal cut away by relief cutting assemblies 28 and 30, respectively, into the conveyor collecting assembly 34.

The conveyor collecting assembly 34 has side conveyor aprons 120 and 122 which drive inwardly toward the center of the machine, and a center conveyor apron 124 which receives material from the side conveyors as well as from the front undercutting drum assembly 26, and moves the material rearwardly to the main unit 22. Preferably, the conveyor aprons are of the rubber coated wire mesh type; however, other conveyor aprons may be suitable. Conveyor apron 120 is engaged on a drive shaft 126 and an idler shaft 128. Drive shaft 126 is driven by a hydraulic motor 130 on one end thereof, and is journaled on the opposite end in a worm gear box 132. Conveyor apron 122 is engaged on a drive shaft 134 and an idler shaft 136. Drive shaft 134 is driven by a hydraulic motor 138, and is journaled on the opposite end in a worm gear box 140. A shaft 142 is mounted between and driven by worm gear boxes 132 and 140. Sprockets 144 and 146 are disposed on drive shaft 142 and provide rotational power to drum 36 through drive chains 148 and 150 engaged on the sprockets on the drive shaft and on sprockets 152 and 154 on drum 36. Thus, hydraulic motors 130 and 138 drive side conveyors 120 and 122 as well as the front undercutting drum 36. Center conveyor apron 124 is mounted on an idler shaft 156 and a drive shaft 158, the drive shaft being driven by a hydraulic motor 160.

Figure 10:
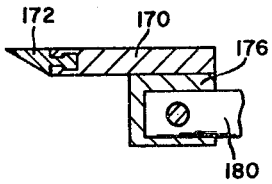
FIG. 10 is a vertical cross sectional view of the chisel bar assembly of the present mining machine, taken on line 10—10 of FIG. 1.
Figure 11:
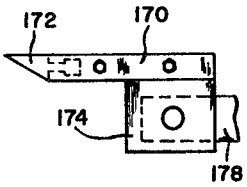
FIG. 11 is a side elevational view of the chisel bar assembly shown in cross section in FIG. 10.

Chisel bar assembly 32 which breaks away the coal from the coal vein above the undercut and between the side relief cuts, has a cutting plate 170 with a replaceable cutting blade 172 attached thereon. Blade 172 is easily removed from plate 170 when the blade must be sharpened or replaced, and down time is substantially decreased when repairs are being made if replacement blades are used, so that while one blade is being sharpened the mining machine need not remain idle. Cutting plate 170 is attached by cutting plate adapters 174 and 176 to cylinder rods 178 and 180 of hydraulic cylinders 182 and 184. This structure is most clearly shown in FIGS. 10 and 11. The cylinder rods are protected by telescoping cylinder rod boots 186 and 188 from dust and other particles which can clog or otherwise mar the cylinder rods and inhibit the action thereof. Cylinders 182 and 184 supply equal pressure to cutting plate 170 when forcing it into the vein of coal. The coal dislodged by cutting plate 170 falls onto the conveyor collecting assembly 34, is moved toward the center of the mining machine by side aprons 120 and 122, and is taken by center conveyor apron 124 to the rear of the ore dislodging and collecting mechanism 24 to be transferred to the main body unit 22 of the machine. The hydraulic cylinders 182 and 184 may be covered by reinforcing frame plates 190 and 192, as shown in FIG. 1, and reinforcing members 194 and 196 may be disposed rearwardly from cylinders 182 and 184.

After the undercut has been made by undercutting drum assembly 26, and the side relief cuts and chisel bar dislodgement have been completed it is necessary to elevate the relief cutting assemblies 28 and 30 and chisel bar assembly 32 to extract the coal just above the initial entry and extraction. This is accomplished by a scissor jack assembly 200 shown in FIG. 5, which raises the relief cutting asemblies 28 and 30 and the chisel bar assembly 32 and will keep them parallel with the initial undercut and the floor of the mine tunnel. Before being raised, the side relief cutting assemblies may be moved to their lowered position as shown in FIG. 2 or may be left in the raised position as shown in FIG. 3, and the chisel bar assembly is moved to the retracted position. If the side relief cutting assemblies are left in the raised positions relief cuts and made while scissor jack assembly 200 is being elevated. If the side relief cutting assemblies are lowered, the relief cuts are made after scissor jack assembly 200 is elevated. After the relief cuts are made, chisel bar assembly 32 can dislodge the coal between the relief cuts. In this "step-up" manner, progressively higher extractions are made until the ceiling level is reached.

Figure 5:
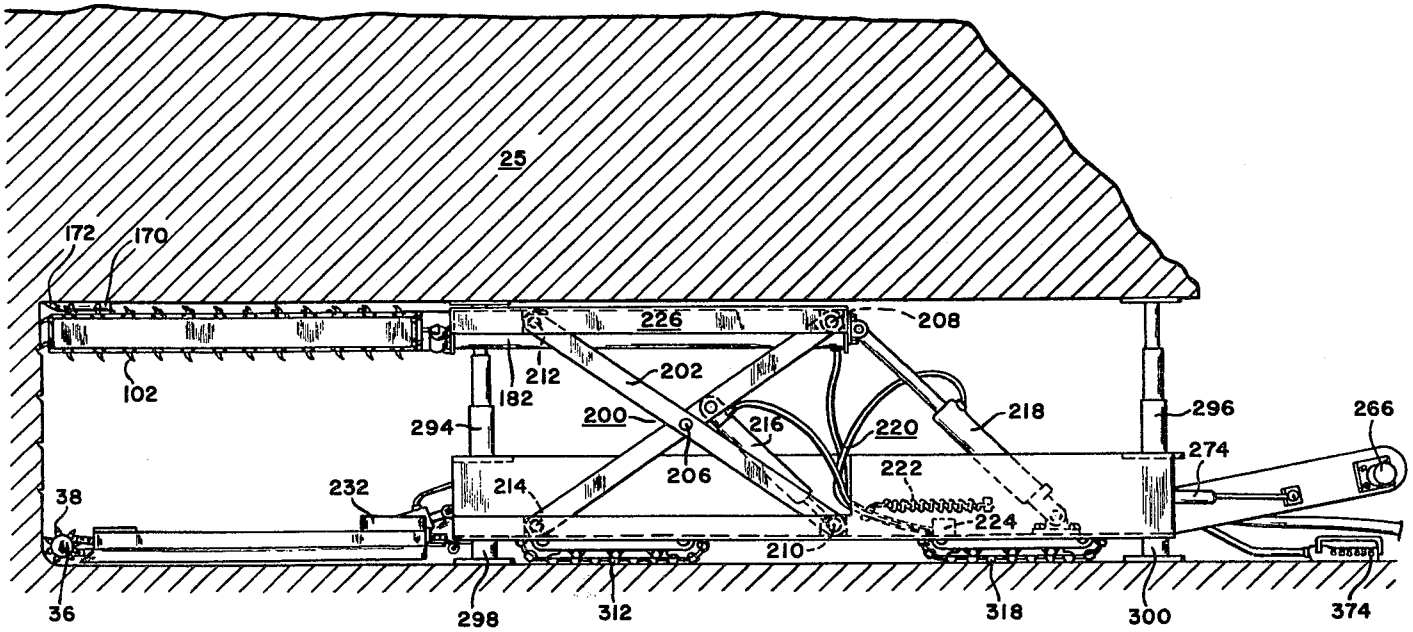
FIG. 5 is a side elevational view of the present mining machine, showing the machine after having completed its highest extraction of coal from a coal vein.
Figure 9:
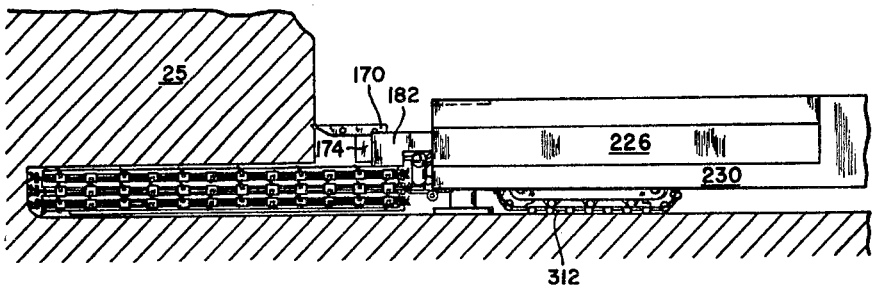
FIG. 9 is a side elevational view of the present mining machine showing the machine in its lowest cutting position.

Crossing scissor arms 202 and 204 are shown on the left side of mining machine 20 in FIG. 5, and an identical mechanism as that to be described herein is provided on the opposite side of the mining machine from that shown. Scissor arms 202 and 204 are pivoted centrally by a center pivot shaft 206. The ends of scissor arms 202 and 204 most rearward from the undercutting assembly are connected by pivot shafts 208 and 210 to the frame of the mining machine. The forward ends of the scissor arms have roller bearings 212 and 214 in tracks on the mining machine frame, so that the forward ends of the arms may move rearwardly as the assembly is raised. One or more hydraulic lifting cylinders, such as that designated with numeral 216, are provided for each of the scissor arm pairs. Additionally, to provide reinforcement in the elevated positions, a reinforcing hydraulic cylinder 218 is provided on each side of the mining machine. Appropriate pivotal connections are provided for each of the hydraulic cylinders, and hydraulic line connections 220 having a retainer spring 222 and a hydraulic junction box 224 connect the hydraulic cylinders to the main hydraulic system of the mining machine. Appropriate body cover plates such as 226 and 230 shown in FIG. 9 enclose the entire scissor jack assembly when the mining machine is in the lowest or entry level position.

During the initial undercut made by front undercutting drum assembly 26, and during the subsequent higher extractions done by the side relief cutting assemblies 28 and 30 and chisel bar assembly 32, the undercutting drum assembly 26 and conveyor collecting assembly 34 rest at the floor level of the mine tunnel. When the mining machine is to be moved to another part of the mine, the conveyor collecting assembly and undercutting drum assembly are lifted off the mine floor by hydraulic cylinders 232 and 234.

Figure 6:
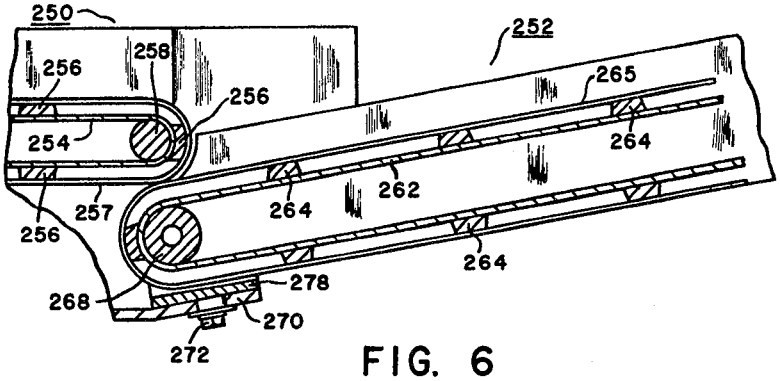
FIG. 6 is a cross sectional view of the main body conveyor and rear swing conveyor of the present mining machine, taken on line 6—6 of FIG. 1.
Figure 7:
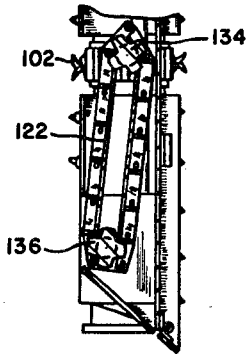
FIG. 7 is a cross sectional view of the left swing bar assembly of the mining machine shown in FIG. 1, taken on line 7—7 of the figure.
Figure 8:
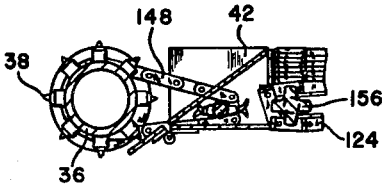
FIG. 8 is a cross sectional view of the front undercutting assembly of the mining machine shown in FIG. 1, taken on line 8—8 of the latter figure.

The conveyor system of the main body unit 22 consists essentially of two conveyors 250 and 252. The main central conveyor 250 receives the extracted coal from the conveyor collecting assembly 34 and moves the coal rearwardly to swing conveyor 252, which transfers the coal to mine cars for removal from the mine. Central conveyor 250 has a conveyor pan 254 which holds the coal being moved by a conveyor apron consisting of a plurality of flight bars 256 on an apron chain 257. A drive shaft 258, connected to a hydraulic drive motor 260, provides propulsion for the main conveyor. The swing conveyor 252 has a conveyor pan 262 and a plurality of flight bars 264 on an apron chain 265 to move the coal in the conveyor pan. A drive motor 266 drives the conveyor from the outward end thereof, and an idler shaft 268 is disposed on the inner end of the conveyor. Swing conveyor 252 is pivotally connected to a main frame member 270 of the mining machine, and the inner end of the conveyor is disposed slightly under the outer end of central conveyor 250, as is clearly shown in FIG. 6. Hence, the coal being transported on central conveyor 250 will fall from the end of the central conveyor into swing conveyor 252. As previously stated, swing conveyor 252 is pivotally mounted about a pivot shaft 272 and hydraulic cylinders 274 and 276 can move the conveyor about the pivot shaft; thus, the angle of swing conveyor 252 with respect to central conveyor 250 can be changed and the swing conveyor can be moved into position to deposit coal extracted by mining machine 20 into mine cars for removal from the mine. The swing conveyor may be mounted to the mining machine in a manner such that it is also vertically pivotal, and cylinder 276 may be mounted so that the swing conveyor can be raised and lowered in addition to being moved horizontally, thus insuring that the conveyor will always rise above the side of the mine cars being loaded. An appropriate turn table 278 may be provided to insure smooth rotational movement of the swing conveyor about pivot shaft 272.

Roof support jacks 290, 292, 294 and 296 are provided to give support to the roof of the mine tunnel above mining machine 20, and to stabilize the mining machine during the extraction process. Additionally, floor jacks are provided, two of which are shown in FIG. 5 and designated with the numerals 298 and 300. The floor jacks are provided to further stabilize the machine during extraction, as well as to elevate the machine when the position of the tramming tracks, to be described subsequently, is being changed. The floor and ceiling jacks are all hydraulically operated and are connected to the main hydraulic system of the mining machine.

Figure 12:
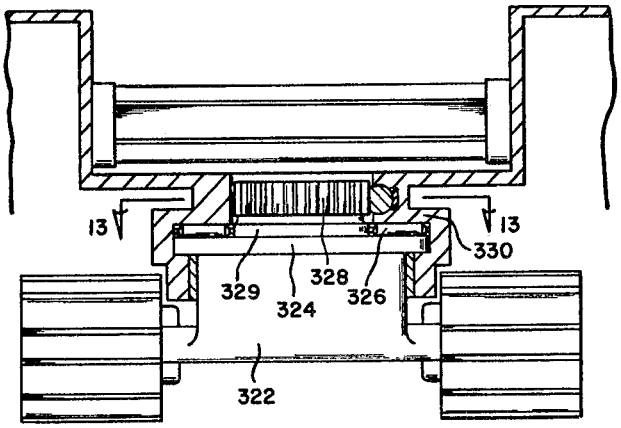
FIG. 12 is an end elevational view of the front tramming track assembly of the mining machine shown in the preceding figures.
Figure 13:
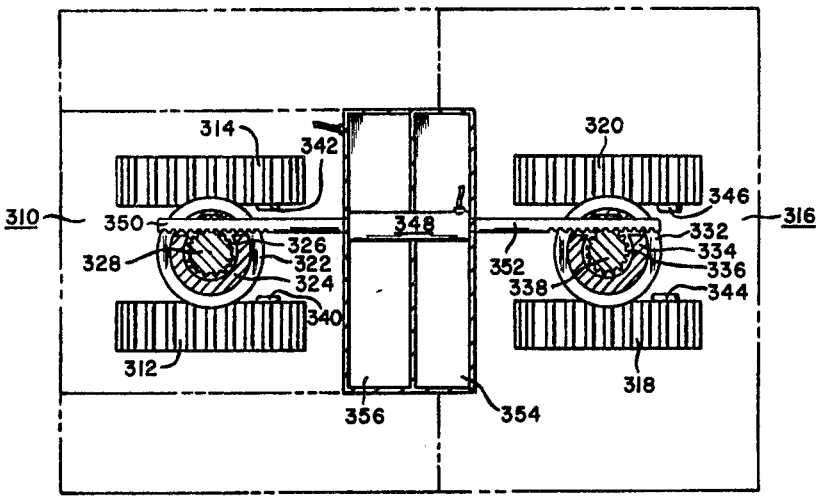
FIG. 13 is a horizontal cross sectional view of the tramming track assembly shown in FIG. 12, taken on line 13—13 of the latter figure.
Figure 14:
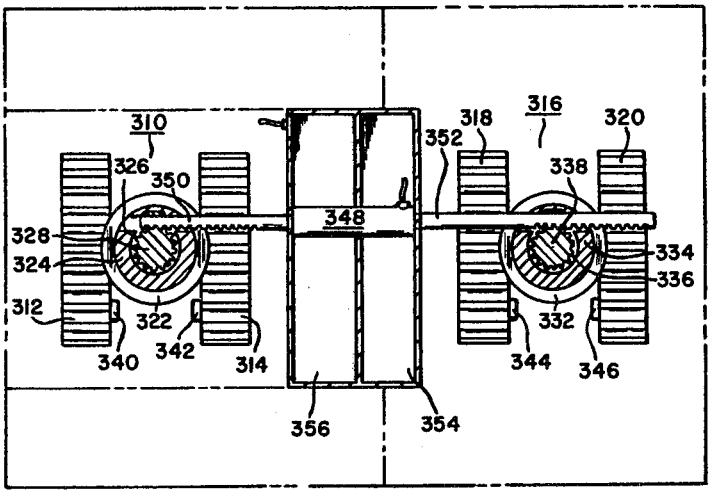
FIG. 14 is a cross sectional view similar to that shown in FIG. 13 but having the tramming track assemblies in a different position.

Transport of the mining machine is performed by the tramming track system, shown most clearly in FIGS. 12 through 14, which includes a front track assembly 310 having tracks 312 and 314, and a rear track assembly 316 having tracks 318 and 320. Front track assembly 310 includes a lower housing member 322 with side projections, shown in FIG. 12, to which the tracks are mounted in a conventional manner. All of the tracks of the present mining machine can be of conventional design used in mining operations. A needle bearing deck 324 is disposed on top of assembly housing 322 with needle bearings 326 thereabove. A pinion gear 328, having a tiered pedestal 329, is attached to the needle bearing deck 324 for rotation therewith. Bearing 326, being disposed between a main frame member 330 of the mining machine and bearing deck 324, permits rotation of the track assembly in relation to the mining machine. Rear track assembly 316 is similar to the front track assembly, having an assembly housing 322, a needle bearing deck 334, needle bearings 336 and a pinion gear 338. Thus, the rear track assembly is also rotational with respect to the mining machine. Hydraulic motors 340 and 342 are provided on the front track assembly, and hydraulic motors 344 and 346 are provided on the rear track assembly to drive the tracks. A hydraulic cycle cylinder 348 is disposed centrally between front track assembly 310 and rear track assembly 316 and has outwardly extending rack rods 350 and 352 which engage with pinion gears 328 and 338, respectively. The cycle cylinder 348 extends or retracts the rack rods to turn the pinion gears and the tracks, as shown in FIG. 14. A hydraulic fluid reserve tank 354 is disposed between the front and rear track assemblies, and contains hydraulic fluid for operation of all hydraulic mechanisms.

Figure 4:
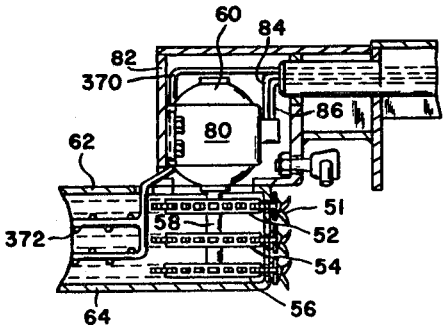
FIG. 4 is a vertical cross sectional view of the right swing bar assembly of the mining machine shown in FIG. 1, taken on line 4—4 of the latter figure.

Several safety features are easily incorporated in the present mining machine. A water spraying system having a water supply tank 356 between the track assemblies, and water lines 370 extending therefrom to the front undercutting drum assembly and side relief cutting assemblies, as shown in FIG. 4 can be added. The water is sprayed on the surfaces of the coal vein through nozzles 372 in lines 370 and moistens the dust particles created by the various cutting chains, thereby substantially reducing the amount of dust in the air. Additionally, since the mining machine of the present invention is essentially all hydraulic in operation, it may be operated by a remote control unit 374 connected to the machine by a cable 376. Hence, the operator of the present mining machine can be positioned substantially rearwardly from the working face of the coal vein, in an area in which the roof of the mine tunnel has already been secured by roof bolts and molleys, as is commonly done in mining. The roof portion above the mining machine is supported by the roof jacks previously described.

In the use and operation of a mining machine embodying the present invention, the machine is moved on track assemblies 310 and 316 until front undercutting drum assembly 26 encounters the working face of the coal vein. During the initial entry, coal dislodging and collecting mechanism 24 is in its lowermost position and chisel bar assembly 32 is in a retracted position at the rear of conveyor collecting assembly 34. The hydraulic motors of side relief cutting assemblies 28 and 30 are turned on so that the cutting chains of the assemblies are turning, and teeth 51 and 102 on the cutting chains will cut through the coal vein when the mining machine advances. Hydraulic motors 130, 138 and 160 are also turned on so that side conveyor aprons 120 and 122 and center conveyor apron 124 will be moving. The hydraulic motors 130 and 138 also drive drum 36 through the worm gear boxes 132 and 140 having shaft 142 therebetween, with drive chains 148 and 150 engaged on sprockets 144 and 146 of drive shaft 142, and sprockets 152 and 154 on undercutting drum 36. Thus, in this state of activation of ore dislodging and collecting mechanism 24, the chains of side relief cutting assemblies 28 and 30 are rotating, drum 36 is turning, side conveyors 120 and 122 are moving inwardly, and center conveyor 124 is moving rearwardly. The side relief cutting assemblies are in the lowered position and the chisel bar assembly is retracted. Mining machine 20 can now begin the advance undercut. As the coal vein is encountered, teeth 38 on drum 36 will cut the coal away, as will teeth 51 and 102 on the side relief cutting assemblies. The coal dislodged by drum 36 is directed by spring plates 40, 42 and 44 onto the conveyor collecting assembly 34. Spring plates 106 and 108 direct the coal cut by side relief cutting assemblies 28 and 30 into the conveyor collecting assembly 34. The side conveyor aprons 120 and 122 of assembly 34 move the coal to the central conveyor apron 124, which moves it rearwardly to conveyor 250 of unit 22, which in turn carries it rearwardly to swing conveyor 252 for loading into the mine cars.

The advance undercut is continued until blade 172 of cutting plate 170 meets the working face of the coal vein, at which point forward movement of the mining machine is stopped. The hydraulic lift cylinders, such as cylinder 92 shown for relief cutting assembly 30, are used to raise the relief cutting assemblies, while the cutting chains thereof continue to operate, from the lowered position as shown in FIG. 2 to the raised position as shown in FIG. 3. Thus, a side cut or kerf is made from the level of the undercut to the height of chisel bar assembly 32, and, at this point in the coal extraction procedure, a block of coal has been separated from the vein on the bottom and sides thereof. The front portion of the mining machine, including substantially the entire length of the conveyor collecting assembly 34, has tunneled into the coal vein with the aforementioned block of coal suspended thereabove. Chisel bar assembly 32 can now be used to dislodge the block of coal in the coal vein above the undercut and between the side relief cuts. Hydraulic cylinders 182 and 184 force blade 172 into the coal to break away relatively large pieces from the vein. The coal dislodged by the chisel bar assembly falls into the conveyor collecting assembly 34, where side conveyor aprons 120 and 122 move it inwardly onto central conveyor apron 124, which carries it to the rear end of ore dislodging and collecting mechanism 24, from which it moves onto central conveyor 250 of unit 22 and is moved rearwardly to swing conveyor 252, and from there to shuttle cars or other haulage equipment for removal from the mine. Since very little of the coal is ground away by the undercutting assembly and side relief cutting assemblies, with most of the coal instead being merely broken away by the chisel bar assembly in relatively large pieces, very little dust is created during the extraction. Hence, the problems associated with the high concentrations of coal dust which result from continuous mining operations, are extensively reduced. Also less methane gas is released and lower volume ventilation may be used in the mine tunnel. The larger chunk coal is easier to handle during transport and requires less processing to clean the sulfur therefrom.

To extract coal from vein 25 at a higher position, the upper portion of the mining machine, including the side relief cutting assemblies 28 and 30 and the chisel bar assembly 32, must be raised by scissor jack assembly 200. To do this, cutting plate 170 is retracted to its most rearward position near the rear of conveyor collecting system 34. Hydraulic cylinders 216 and 218 are used to raise the scissor jack assembly by lifting scissor arms 202 and 204, moving them from a substantially horizontal position to a more vertical one. The forwardmost ends of the scissor arms roll on roller bearings 212 and 214 rearwardly within the frame of the mining machine, thereby providing a substantially vertical lift of the side relief cutting assemblies and chisel bar assembly together with frame members such as 226. In its retracted position, the chisel bar assembly will again be in front of the working face of the coal vein and will slide upwardly along the working face as the chisel bar is raised. As the scissor jack is raised, side relief cutting assemblies 28 and 30 make side relief cuts in the coal vein. After the relief cuts are made chisel plate 170 is again hydraulically forced into the coal vein to dislodge the coal therefrom. The progressive elevation of the relief cutting assemblies and chisel plate is continued until the coal is extracted up to the height of the roof of the mine tunnel. As shown in FIG. 5, a series of progressively higher extractions may be required to ahcieve the desired height within the mine tunnel. During the progressively higher extractions, front undercutting drum assembly 26 and the conveyor collecting assembly 34 remain on the floor of the mine tunnel. The coal cut away by side relief cutting assemblies 28 and 30, and the coal dislodged by cutting plate 170, falls onto the conveyor collecting assembly 34 at the floor of the mine tunnel and is transported to shuttle cars for removal from the mine.

Since the operator of the mining machine has complete control over the height and positioning of chisel bar assembly 32 through control of the elevation of the scissor jack assembly, it is relatively simple to separate unwanted material or binders, commonly found in the coal vein, from the desired coal. The chisel bar assembly can be positioned to extract all of the coal up to the ribbon of binder material. The unwanted material can then be extracted and loaded on to shuttle cars and discarded. The present mining machine, which makes substantially horizontal extractions, can be operated to extract relatively thin layers of material. This is particularly advantageous over the continuous mining machines, which use large grinding drums on the front of the machine to extract the material from the coal vein. The prior machines often extract over a very large area; hence, unwanted material becomes mixed with the desired coal. The machine of the present invention permits extraction of thin layers; hence, the unwanted material can be separated easily from the coal in the coal vein.

Frequently the binder in the coal vein is a fairly hard or solid material. To stabilize the mining machine during extraction of the hard materials, the roof jacks 290, 292, 294 and 296 can be hydraulically extended to push against the roof of the mine tunnel. Floor jacks, such as 298 and 300 shown in FIG. 5, can also be extended to wedge the mining machine in the mine tunnel. The chisel bar assembly can then be forced into the hard material without the mining machine being pushed rearwardly by the forward thrust of the chisel bar assembly. The roof jacks provide an additional benefit in that they can be used to support the roof directly above the mining machine, which is an area which normally will not as yet have been secured by roof bolts and mollies.

The coal extracted by dislodging and collecting mechansim 24 is transported to conveyor 250 on unit 22 by the center conveyor arpon 124 of the forward unit. The coal is deposited into conveyor pan 254 and is moved by flight bars 256 on apron chain 257 along the conveyor pan to the rear portion of the mining machine. As is clearly shown in FIG. 6, the coal will fall from pan 254 into pan 262 of swing conveyor 252, and will be moved in the conveyor pan by the flight bars 264 of apron chain 265. The pivotal mounting of swing conveyor 252 permits hydraulic cylinder 274 to move the swing conveyor to the position required for loading into shuttle cars. Additionally, hydraulic cylinder 276 can be used to raise or lower the outer end of conveyor 252, to ensure that the conveyor will be positioned over the side of the shuttle cars.

When the desired roof height has been reached and extraction completed for the initial positioning of the mining machine, a second extraction immediately adjacent the initial extraction can be made. The floor jacks are extended to lift the mining machine so that tracks 312, 314, 318 and 320 are raised off the floor. Hydraulic cycle cylinder 348 is used to alter the positioning of rack rods 350 and 352, thereby turning pinion gears 328 and 338. The needle bearings 326 and 336 disposed between the bearing decks and the frame of the mining machine permit the pinion gears, pedestals, and assembly housings to turn, hence turning the tracks 90° as shown in FIG. 14. The mining machine is now in position to move in a direction 90° away from that of the initial orientation and extraction by the machine. Normally, the scissor jack assembly 200 will be lowered so that the mining machine is in the same position as for the first entry in the vein, that is at the floor level. As the mining machine moves to the right, the right side relief cutting assembly 30 is the lead cutting unit and undercuts the coal vein. The machine moves in this direction until the left side relief cutting assembly 28 is near the edge of the coal vein which formed the right wall during the initial entry and extraction. The movement of the mining machine is stopped, and the side relief cutting assemblies 28 and 30 are moved from their lowered position to the raised position. When this is done, the right side relief cutting assembly 30, which has undercut the coal vein, will again cut within the vein as it is raised. The left side relief cutting assembly, being positioned in the area in which the initial extraction took place, will not encounter coal as it is raised. Upon completion of the elevation of the side relief cutting assemblies, the chisel bar assembly 32 is forced into the coal vein to dislodge the coal therefrom. Scissor jack assembly 200 can be used to elevate the chisel bar assembly and side relief cutting assemblies so that progressively higher extractions can be made in the coal vein at the new position of the mining machine.

As previously stated, since very little coal is actually ground away by the undercutting drum assembly or side relief cutting assemblies, but instead most of the coal is dislodged by the chisel bar assembly, there is very little finely ground coal resulting from the procedure used in the present invention. Hence, the amount of dust created is substantially reduced; however, even the minimal amounts of dust created can be controlled and prevented from circulating throughout the mine tunnel by the use of water supply tank 356 and water lines 370 and nozzles 372. By disposing the nozzles near the cutting chains and teeth of the various cutting assemblies, water spray can be directed on the area being cut so that the cut material is moistened, thereby making it heavy enough to prevent it from easily circulating in the air, but instead forcing it to fall into the conveyor collecting system together with the larger pieces of extracted coal. Since very little dust is created in the present procedure, and since what little dust is created can be easily controlled by the water spray system, the safety problems associated with coal dust are substantially reduced. Additionally, since the coal extracted by the present mining machine is mainly in large chunks, the creation of methane gas is also greatly reduced. Hence, the exceptionally high volume ventilation fans, presently required to remove the methane gas created in continuous mining operations, are no longer needed. In addition to the reduction in the creation of methane gas and coal dust, safety of the mine workers is increased by the present mining machine, since all the power supplied near the working face of the coal vein, where methane gas and coal dust concentrations are highest, is hydraulic power. Since no blasting is required, ignition sources of the volatile materials are eliminated. The electrical power required to operate the mining machine is maintained at the rear of the mining machine, a substantial distance away from the working face and highest concentrations of volatile substance.

The present mining machine is easily operated by remote control unit 374 connected to the mining machine by cable 376. The various hydraulic motors can be turned on and off at the remote control unit; hence, the operator can remain, at all times, in areas where the roof of the mine tunnel has been secured by roof bolts and mollies. Danger to the operator from cave-ins near the working face is substantially reduced.

It is also clear that the operation of the present mining machine is significantly faster than previous mining machines. Very little grinding or chewing away of the coal vein is required. The extraction of the chisel bar assembly 32 is significantly faster than the grinding procedure used by previous continuous mining machines, or by the drilling, loading and blasting used in conventional mining. Thus, the mining machine of the present invention increases the safety associated with the mining procedure and also substantially increases the output capacity per man hour. Also, the complete incorporation of the extraction and loading functions in one machine substantially reduces the number of workers needed to operate the mining machine. This, too, saves labor costs and reduces the expense per coal output ton.

Although one embodiment of the present mining machine has been described in detail herein, various changes can be made without departing from the scope of the present invention.

I claim:

1. An ore dislodging mechanism for extracting ore from a vein of ore, comprising a chisel bar for breaking ore from the vein of ore, a cutting edge on said chisel bar adapted for entering the vein of ore, a power means for forcing said chisel bar into the vein of ore, along a path generally parallel with the floor of the mine tunnel, an elevating means including a vertically movable support assembly for raising said chisel bar in a substantially vertical line so that progressively higher extractions from the vein of ore can be made parallel with lower extractions, and relief cutting means mounted on said vertically movable support assembly at each side of said chisel bar for cutting kerfs in the vein of ore from a point in the vein lower than said chisel bar to a point substantially at the level of said chisel bar, said support assembly raising and lowering said chisel bar and said relief cutting means as a unit while permitting said bar and cutting means to move relative to one another.

2. An ore dislodging mechanism as defined in claim 1 in which an undercutting means is provided for cutting a horizontal kerf in the vein of ore at the floor level of the mine tunnel.

3. An ore dislodging mechanism as defined in claim 1 in which said cutting edge is substantially continuous along the front of said chisel bar.

4. An ore dislodging mechanism as defined in claim 3 in which said cutting edge is a removable cutting blade on said chisel bar.

5. An ore dislodging mechanism as defined in claim 4 in which said power means includes at least one hydraulic cylinder for forcing said chisel bar into the vein of ore.

6. An ore dislodging mechanism as defined in claim 1 in which said cutting edge is a removable cutting blade on said chisel bar.

7. An ore dislodging mechanism as defined in claim 1 in which said power means includes at least one hydraulic cylinder for forcing said chisel bar into the vein of ore.

8. An ore dislodging mechanism as defined in claim 7 in which an undercutting means is provided for cutting a horizontal kerf in the vein of ore at the floor level of the mine tunnel.

9. An ore dislodging mechanism as defined in claim 1 in which a collecting means is provided below said chisel bar for gathering the ore dislodged by said chisel bar.

10. An ore cutting and dislodging mechanism comprising side cutting means for extending kerfs in a vein of ore between a lower level and a higher level in the vein, a chisel bar adapted to break ore from the vein between said kerfs, power means for driving said chisel bar into the ore between said kerfs, and an elevating means supporting said side cutting means and chisel bar for raising said cutting means and said chisel bar together in a line perpendicular to the line of movement of said chisel bar into the vein of ore.

11. An ore cutting and dislodging mechanism as defined in claim 10 in which a gathering means is provided for collecting the ore broken from the vein by said chisel bar.

12. An ore cutting and dislodging mechanism as defined in claim 10 in which an undercutting means is provided for cutting a kerf below said chisel bar at the floor level of a mine tunnel.

13. A method for extracting ore from a vein of ore comprising the steps of moving a cutting means into the face of a vein of ore to make an undercut beneath the ore to be extracted from the vein, cutting vertical relief cuts upwardly from the undercut, forcing a chisel means into the vein of ore to dislodge ore between the vertical relief cuts and above the undercut, bodily raising the cutting means and chisel means together while permitting relative movement therebetween, forcing the chisel means into the vein a second time in a path substantially parallel with the first entrance of said chisel means, and repeating the steps of raising the cutting means and chisel means in coordinated steps, and forcing the chisel means into the vein in a path parallel with previous entrances of said chisel means in the vein until the desired height of vertical extraction of ore has been attained.

14. The method for extracting ore as defined in claim 13 which further includes the steps of gathering the ore dislodged by said chisel means and loading the ore into a transport means for removal from the mine.

15. The method for extracting ore as defined in claim 13 which further includes the step of cutting progressively higher relief cuts from the top of a previous extraction to the desired level of a subsequent extraction.

16. A method for extracting ore from a deposit of ore adjacent a previous extraction, comprising cutting into the deposit to form an undercut, cutting a vertical relief cut in the deposit in spaced relation to the previous extraction and upwardly from the undercut, forcing a chisel means into the deposit between the relief cut and the area of the previous extraction to dislodge ore from the deposit, and progressively raising the cutting and chiseling operations in coordinated steps until the desired height of vertical extraction of ore has been attained.

17. A method for extracting ore from a deposit of ore adjacent a previous extraction as defined in claim 16 which includes the step of extending the vertical relief cut upwardly in the deposit.

18. A method for extracting ore from a deposit of ore adjacent a previous extraction as defined in claim 16 which includes the steps of gathering the cut and dislodged ore and loading the ore into transport means for removal from the mine.

* * * * *